US010850160B2

(12) United States Patent
Friedman et al.

(10) Patent No.: US 10,850,160 B2
(45) Date of Patent: Dec. 1, 2020

(54) SYSTEMS AND METHODS FOR FACILITATING REHABILITATION AND EXERCISE

(71) Applicant: Flint Rehabilitation Devices, LLC, Irvine, CA (US)

(72) Inventors: Nizan Friedman, Irvine, CA (US); Daniel K. Zondervan, Long Beach, CA (US)

(73) Assignee: FLINT REHABILITATION DEVICES, LLC, Irvine, CA (US)

( * ) Notice: Subject to any disclaimer, the term of this patent is extended or adjusted under 35 U.S.C. 154(b) by 159 days.

(21) Appl. No.: 15/867,503

(22) Filed: Jan. 10, 2018

(65) Prior Publication Data

US 2018/0193700 A1 Jul. 12, 2018

Related U.S. Application Data

(60) Provisional application No. 62/444,530, filed on Jan. 10, 2017.

(51) Int. Cl.
*A63B 23/12* (2006.01)
*A63B 23/035* (2006.01)
(Continued)

(52) U.S. Cl.
CPC ..... *A63B 24/0075* (2013.01); *A63B 21/0004* (2013.01); *A63B 21/072* (2013.01);
(Continued)

(58) Field of Classification Search
CPC ..... A63B 24/0075; A63B 24/0062; A63B 71/0622; A63B 23/14; A63B 23/1281; A63B 23/1263; A63B 23/0211; A63B 23/0355; A63B 24/0003; A63B 23/1272; A63B 23/1254; A63B 23/085; A63B 23/10; A63B 23/0482; A63B 21/4043; A63B 24/0087; A63B 2220/833; A63B 23/16; A63B 23/08; A63B 23/0494; A63B 21/4035; A63B 21/4034; A63B 2220/803;
(Continued)

(56) References Cited

U.S. PATENT DOCUMENTS 6,736,015 B1 5/2004 Repperger et al.
6,864,436 B1 3/2005 Nobes et al.
(Continued)

OTHER PUBLICATIONS

"Kelvin, Sero Phone Design is Circular, Very Original, May 5, 2014, https://www.concept-phones.com/cool-concepts/sero-phone-design-circular-original/" (Year: 2014).*

*Primary Examiner* — Loan B Jimenez
*Assistant Examiner* — Shila Jalalzadeh Abyaneh
(74) *Attorney, Agent, or Firm* — Thomas Horstemeyer, LLP

(57) ABSTRACT

In one embodiment, an exercise system includes a user interface device sized and configured to fit within a user's hand, the user interface device including a microcontroller configured to control operation of the device, a first sensor configured to sense movements of the device, a second sensor configured to sense forces applied to the device, and a communication device configured to communicate data concerning the sensed movements and forces to a separate device.

17 Claims, 9 Drawing Sheets

(51) Int. Cl.

| | |
|---|---|
| ***A63B 21/00*** | (2006.01) |
| ***A63B 23/16*** | (2006.01) |
| ***A63B 24/00*** | (2006.01) |
| ***A63B 71/06*** | (2006.01) |
| ***A63B 23/14*** | (2006.01) |
| ***A63B 23/02*** | (2006.01) |
| ***A63B 23/08*** | (2006.01) |
| ***A63B 23/10*** | (2006.01) |
| ***A63B 23/04*** | (2006.01) |
| ***A63B 21/072*** | (2006.01) |
| ***A63B 22/20*** | (2006.01) |
| ***A63B 22/00*** | (2006.01) |

(52) U.S. Cl.

CPC ..... *A63B 21/4043* (2015.10); *A63B 22/0007* (2013.01); *A63B 22/20* (2013.01); *A63B 23/0211* (2013.01); *A63B 23/0355* (2013.01); *A63B 23/04* (2013.01); *A63B 23/0482* (2013.01); *A63B 23/085* (2013.01); *A63B 23/10* (2013.01); *A63B 23/1254* (2013.01); *A63B 23/1263* (2013.01); *A63B 23/1272* (2013.01); *A63B 23/1281* (2013.01); *A63B 23/14* (2013.01); *A63B 24/0003* (2013.01); *A63B 24/0062* (2013.01); *A63B 24/0087* (2013.01); *A63B 71/0622* (2013.01); *A63B 21/4034* (2015.10); *A63B 21/4035* (2015.10); *A63B 23/0494* (2013.01); *A63B 23/08* (2013.01); *A63B 23/1245* (2013.01); *A63B 23/16* (2013.01); *A63B 2022/0092* (2013.01); *A63B 2022/0094* (2013.01); *A63B 2071/0655* (2013.01); *A63B 2208/0233* (2013.01); *A63B 2209/00* (2013.01); *A63B 2220/16* (2013.01); *A63B 2220/40* (2013.01); *A63B 2220/51* (2013.01); *A63B 2220/803* (2013.01); *A63B 2220/833* (2013.01); *A63B 2220/89* (2013.01); *A63B 2225/50* (2013.01); *A63B 2225/74* (2020.08)

(58) Field of Classification Search

CPC ..... A63B 2220/51; A63B 2225/50; A63B 2071/0655; A63B 2207/02; A63B 2209/00; A63B 2208/0233; A63B 23/1245; A63B 2022/0092; A63B 2022/0094; A63B 2220/16; A63B 2220/40; A63B 2220/89; A63B 21/0004; A63B 21/072; A63B 22/0007; A63B 22/20; A63B 23/04; A63B 21/06; A63B 21/065; A63B 21/0724; A63B 21/40; A63B 21/4025; A63B 21/4023; A63B 21/00; A63B 2220/50; A63B 2220/53; A63B 2220/58; A63B 2060/462; A63B 2060/464; A63B 2220/56; A63B 37/0002; A63B 2022/94

See application file for complete search history.

(56) References Cited

U.S. PATENT DOCUMENTS

| | | | | |
|---|---|---|---|---|
| D537,480 | S * | 2/2007 | Sullivan | D19/100 |
| 8,172,723 | B1 * | 5/2012 | Yanev | A63B 24/0062 482/1 |
| 9,369,365 | B2 | 6/2016 | Molettiere et al. | |
| 9,374,087 | B2 | 6/2016 | Han et al. | |
| 9,393,500 | B2 | 7/2016 | Barney et al. | |
| 9,403,056 | B2 | 8/2016 | Weinberg | |
| 9,409,053 | B1 | 8/2016 | Todd | |
| 9,415,266 | B2 | 8/2016 | Weast et al. | |
| 2006/0035762 | A1 * | 2/2006 | Smyser | A63B 21/0023 482/91 |
| 2011/0065550 | A1 * | 3/2011 | Cohn | A63B 21/0004 482/8 |
| 2011/0103004 | A1 * | 5/2011 | Brock | G06F 1/1632 361/679.43 |
| 2013/0073247 | A1 * | 3/2013 | Perkins | G01P 3/44 702/141 |
| 2014/0073446 | A1 * | 3/2014 | Davenport | A63B 24/0003 473/223 |
| 2015/0072811 | A1 * | 3/2015 | Jolliffe | A63B 43/00 473/570 |
| 2015/0170530 | A1 * | 6/2015 | Damman | G09B 5/00 700/91 |
| 2015/0251100 | A1 * | 9/2015 | Barney | A63H 30/04 463/29 |
| 2016/0001136 | A1 * | 1/2016 | King | A63B 69/0071 320/108 |

* cited by examiner

SYSTEMS AND METHODS FOR FACILITATING REHABILITATION AND EXERCISE

CROSS-REFERENCE TO RELATED APPLICATION

This application claims priority to U.S. Provisional Application Ser. No. 62/444,530, filed Jan. 10, 2017, which is hereby incorporated by reference herein in its entirety.

BACKGROUND

Stroke remains the leading cause of chronic adult disability in western countries with over four million survivors currently living in the United States. Following the onset of stroke, patients may receive several weeks of intensive rehabilitation in an attempt to increase cognitive and functional abilities. Through intensive and repetitive motion training, patients may be able to regain lost function through processes such as neural reorganization.

Unfortunately, the length of stay at in-patient rehabilitation facilities may be limited to a few weeks and follow-up outpatient therapy is also often limited. Accordingly, patients must independently continue their therapy on their own at home without access to specialized equipment or the assistance of a physical therapist. While it is possible for an individual to perform home therapy exercises, such exercises are neither engaging nor do they provide any quantitative or qualitative measure of progress. As a result, patients often lose motivation to perform their home therapy. Without such therapy, individuals can experience declines in motor functions that affect their ability to perform activities of daily living. What is needed is an engaging and effective system and method for facilitating home rehabilitation exercise.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, needed is an engaging and effective system and method for facilitating home rehabilitation exercise. Disclosed herein are examples of such systems and methods. In some embodiments, a system comprises one or more user interface devices with which a user can perform home exercises. The system further comprises a software program that guides the user through the exercises and monitors performance of the exercises by receiving data sensed by one or more sensors contained in the user interface devices. In some embodiments, the user interface devices can have a size and shape similar to that of a hockey puck, which enables the device to be manipulated in a variety of ways using various parts of the body. In some embodiments, the user interface devices are wireless and have rechargeable batteries. While the systems and methods have been identified as being intended for home rehabilitation exercises, it is noted that the systems and methods can be used in any exercise context. Accordingly, the systems and methods may more generally be referred to as exercise systems and methods.

In the following disclosure, various specific embodiments are described. It is to be understood that those embodiments are example implementations of the disclosed inventions and that alternative embodiments are possible. All such embodiments are intended to fall within the scope of this disclosure.

Figure 1:
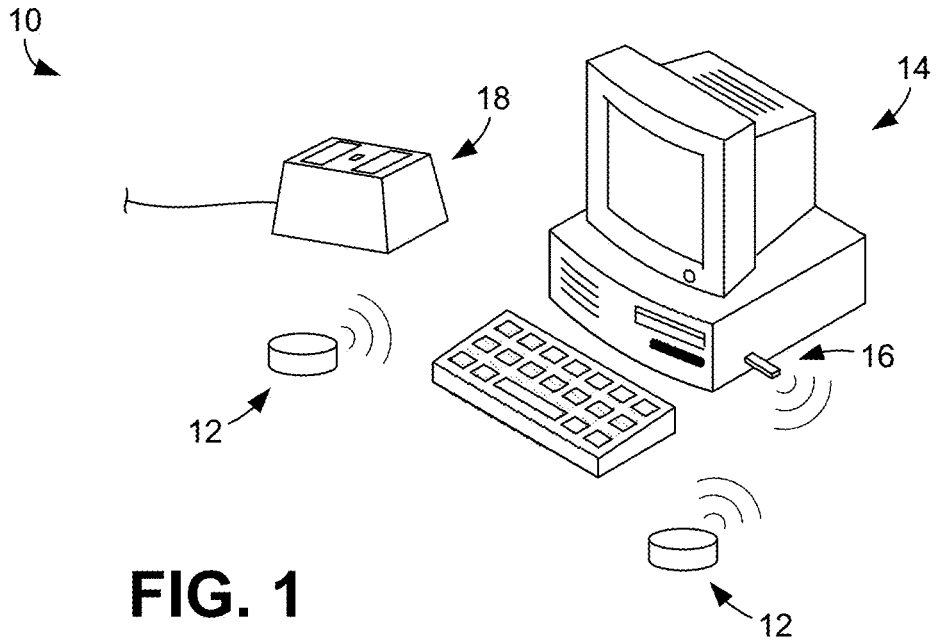
FIG. 1 is a schematic view of a system for facilitating rehabilitation and exercise.

FIG. 1 illustrates an example exercise system 10 that can be used for purposes of home rehabilitation. As shown in the figure, the system 10 generally includes one or more wireless user interface devices 12, a computing device 14, a wireless receiver 16 that plugs into the computing device, and a docking station 18.

Figure 2:
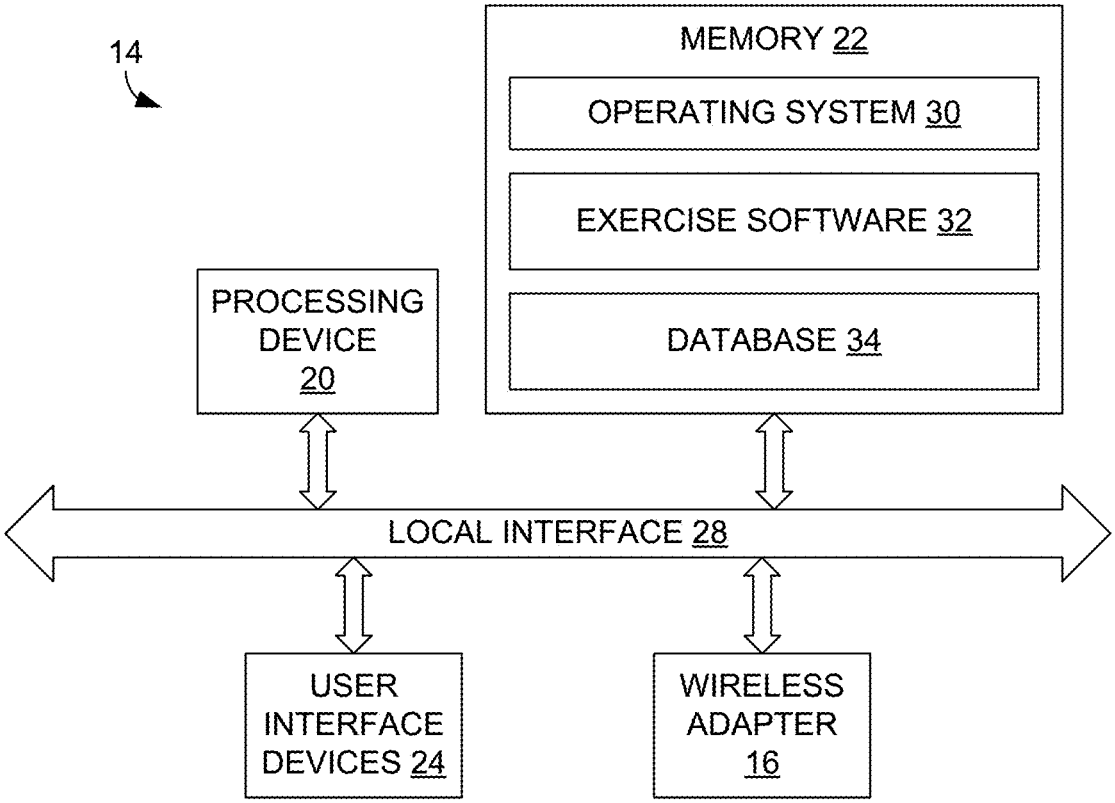
FIG. 2 is a block diagram of a computing device of the system of FIG. 1.

FIG. 2 illustrates an example configuration for the computing device 14 shown in FIG. 1. Although the computing device 14 is illustrated as a desktop computer in FIG. 1, it is noted that the computing device can comprise any device that has the computing power to execute software programs or applications. Accordingly, the computing device can be configured as a notebook computer, a tablet computer, or a mobile phone. As shown in FIG. 2, the computing device 14 generally includes a processing device 20, memory 22, and conventional user interface devices 24, each of which is connected to a local interface 28. The conventional user interface devices 24 can, for example, comprise devices typically used with a computer, such as a keyboard, mouse, and display.

The memory 22 (a non-transitory computing device-readable medium) stores an operating system 30 and exercise software 32. The exercise software 32 comprises one or more software programs, which include one or more algorithms (logic and/or executable instructions), that guide users through exercises that can be performed using the user interface devices 12 and monitor performance of the exercises. In some embodiments, the exercise software 32 further comprises one or more software programs/algorithms that are configured to analyze the data collected from the user interface devices 12 and generate qualitative and/or quantitative information that can be used to assess the patient's condition and progress with his or her therapy or exercise program. As is also shown in FIG. 2, the memory 22 can include a database 34 in which the received data and analysis can be stored.

Figure 3:
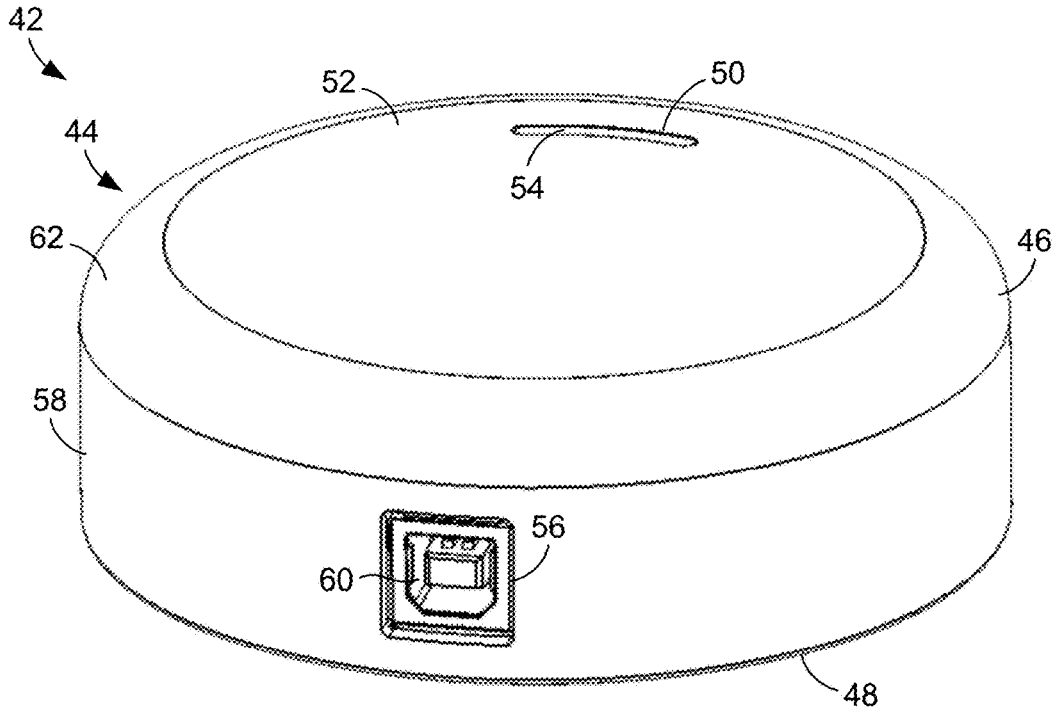
FIG. 3 is a top perspective view of a user interface device of the system of FIG. 1.
Figure 4:
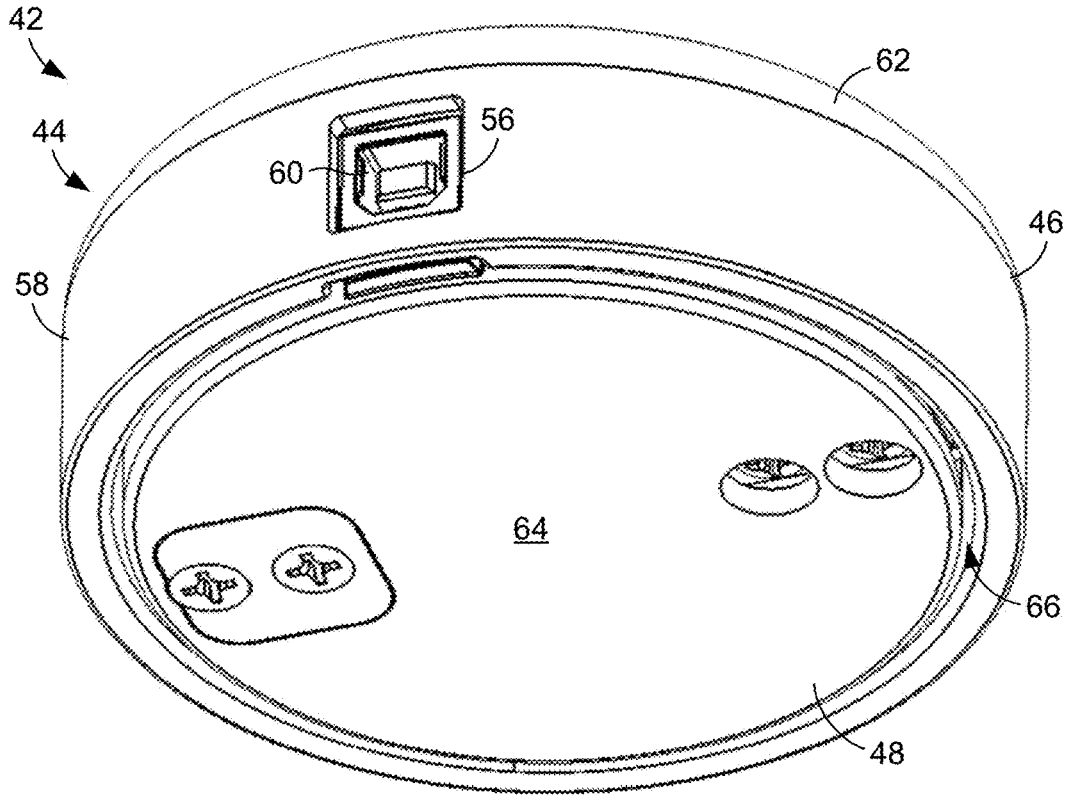
FIG. 4 is a bottom perspective view of the user interface device of FIG. 3.

FIGS. 3-7 illustrate an example embodiment for the user interface devices 12 shown in FIG. 1. With reference first to FIGS. 3 and 4, an embodiment of a user interface device 42 can generally be configured as a short cylindrical puck. More particularly, the user interface device 42 can have a size and shape similar to a hockey puck such that it can be held within the user's hand and easily manipulated. By way of example, the user interface device 42 can have a height of approximately 30 mm and a diameter of approximately 90 mm.

The user interface device 42 includes an outer housing 44 that contains and protects various internal components of the device. The outer housing 44 can be made of a polymeric material. For example, the outer housing 44 can be made of a hard plastic material that is covered with an elastomeric coating to improve grip. As shown in FIGS. 3 and 4, the outer housing 44 comprises a top housing member 46 and a bottom housing member 48. As described below, these two members 46, 48 are connected only by a load cell such that a force with which the top housing member is pressed toward the bottom housing member, and vice versa, can be measured.

As indicated in FIG. 3, the top housing member 46 includes an arcuate window 50 formed in a planar top wall 52 of the member in which is received a lens 54 that is configured to transmit light generated by an internal light source. The top housing member 46 further includes a rectangular window 56 formed in an arcuate lateral wall 58 that extends orthogonally downward from outer edges of the top wall 52. A female electrical connector 60 of the user interface device 42 can be accessed through this window 56. In some embodiments, the electrical connector 60 comprises a universal serial bus (USB) connector (e.g., female USB-B connector) that enables recharging of an internal battery when the user interface device 42 is docked in the docking station 18. As is also shown in FIG. 3, the top housing member 46 can have a circular, rounded edge 62 that is formed at the joint between the top wall 52 with the lateral wall 58. This rounded edge 62 facilitates comfortable gripping of the user interface device 42.

With reference to FIG. 4, the bottom housing member 48 is smaller than the top housing member 46. More particularly, the bottom housing member 48 can have a smaller diameter than the top housing member 46 such that the bottom housing member can be received within an inner space formed by the top housing member, as illustrated in FIG. 4. In such a case, the top housing member 46 surrounds the top and lateral sides of the bottom housing member 48 so that only a base 64 of the bottom housing member is exposed, and therefore visible, when the user interface device 42 is assembled. As shown in FIG. 4, an arcuate lateral gap 66 is formed between an arcuate lateral wall of the bottom housing member 48 and the arcuate lateral wall 58 of the top housing member 46 when such assembly has been completed. The top housing member 46 is dimensioned such that, when the user interface device 42 is placed on a flat surface, such as a table top, the top housing member is spaced from the surface and only the base 64 of the bottom housing member 48 contacts the surface.

Figure 5:
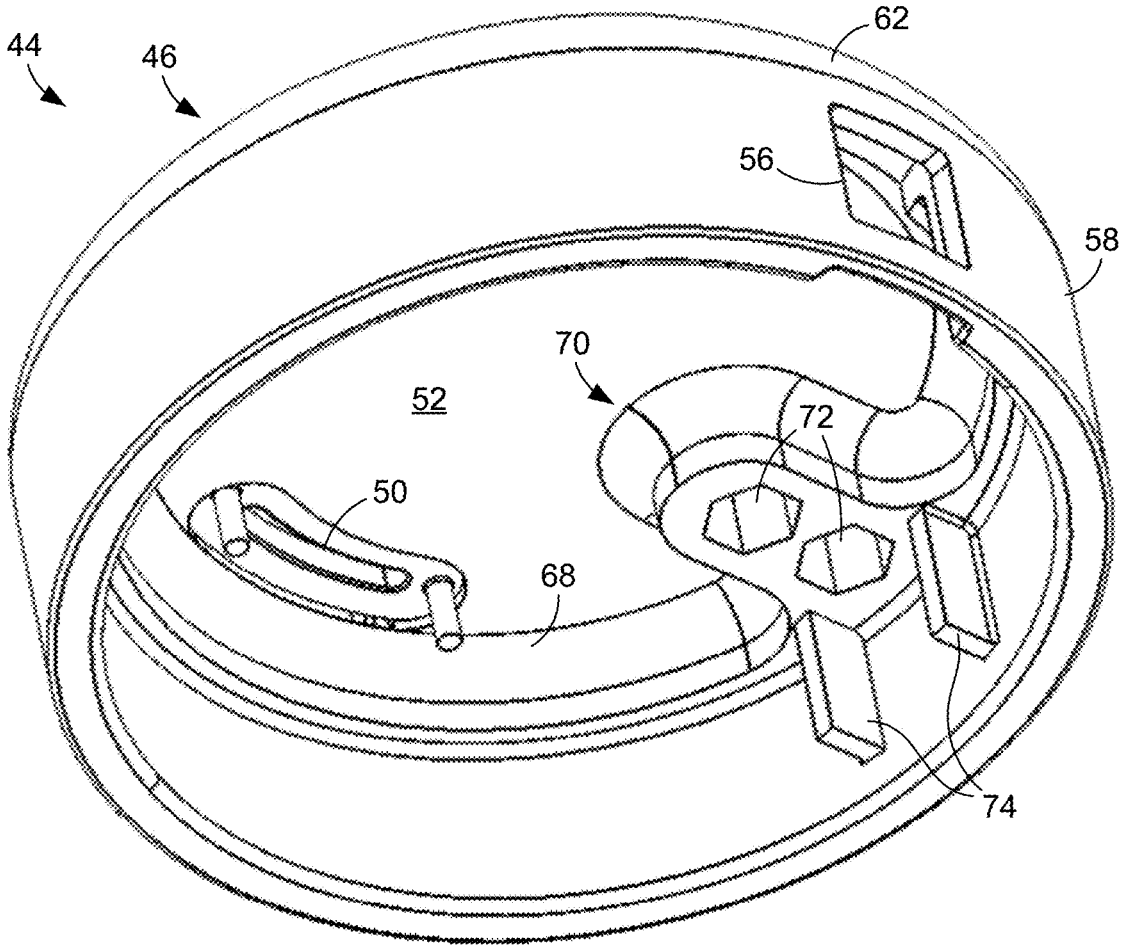
FIG. 5 is a bottom perspective view of a top housing member of the user interface device of FIG. 3.

FIG. 5 shows the top housing member 46 separated from the remainder of the user interface device 42. More particularly, FIG. 5 shows the underside of the top housing member 46 so as to reveal the inner space of the member, which is defined by the planar top wall 52 and the arcuate lateral wall 58. In the illustrated embodiment, an arcuate inner ridge 68 is provided at the joint between the top wall 52 and the lateral wall 58 on the inside of the top housing member 46. When provided, this ridge 68 limits the degree to which the top housing member 46 and the bottom housing member 48 can be moved toward each other. More particularly, the top housing member 46 and bottom housing member 48 can only be moved toward each other until the ridge 68 abuts a top edge of the arcuate lateral wall of the bottom housing member. The ridge 68, therefore, functions as a mechanical stop that limits relative movement between the two housing members 46, 48. This functionality provides protection for the load cell contained within the user interface device 42.

With further reference to FIG. 5, the underside of the top housing member 46 also includes a boss 70 that extends radially inward from the arcuate inner ridge 68 toward a center of the planar top wall 52. This boss 70 includes hexagonal openings 72 that are adapted to receive fastening elements, such as threaded nuts, that engage further fastening elements, such as threaded bolts, that are used to assemble the user interface device 42. In addition, the boss 70 also provides increased structural integrity to the top housing member 46.

Extending downward from the arcuate inner ridge 68 and the boss 70 are two vertical tangs 74. These tangs 74 are adapted to be received within a gap formed in the arcuate lateral wall of the bottom housing member 48 and prevent relative rotation between the top housing member 46 and the bottom housing member. The tangs 74, therefore, function as further mechanical stops that limit relative rotation between the two housing members 46, 48. In addition, the tangs 74 assist in alignment of the top housing member 46 and the bottom housing member 48 during assembly of the user interface device 42.

Figure 6:
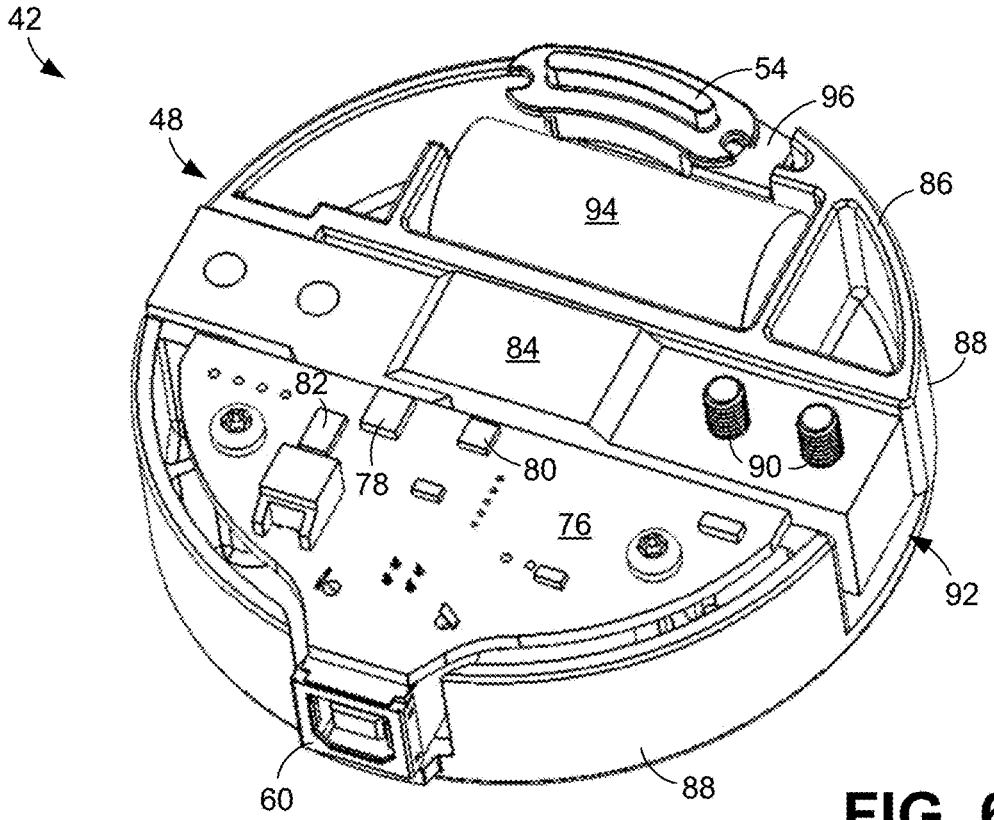
FIG. 6 is a top perspective view of the user interface device of FIG. 3, shown with the top housing member of FIG. 5 removed.
Figure 7:
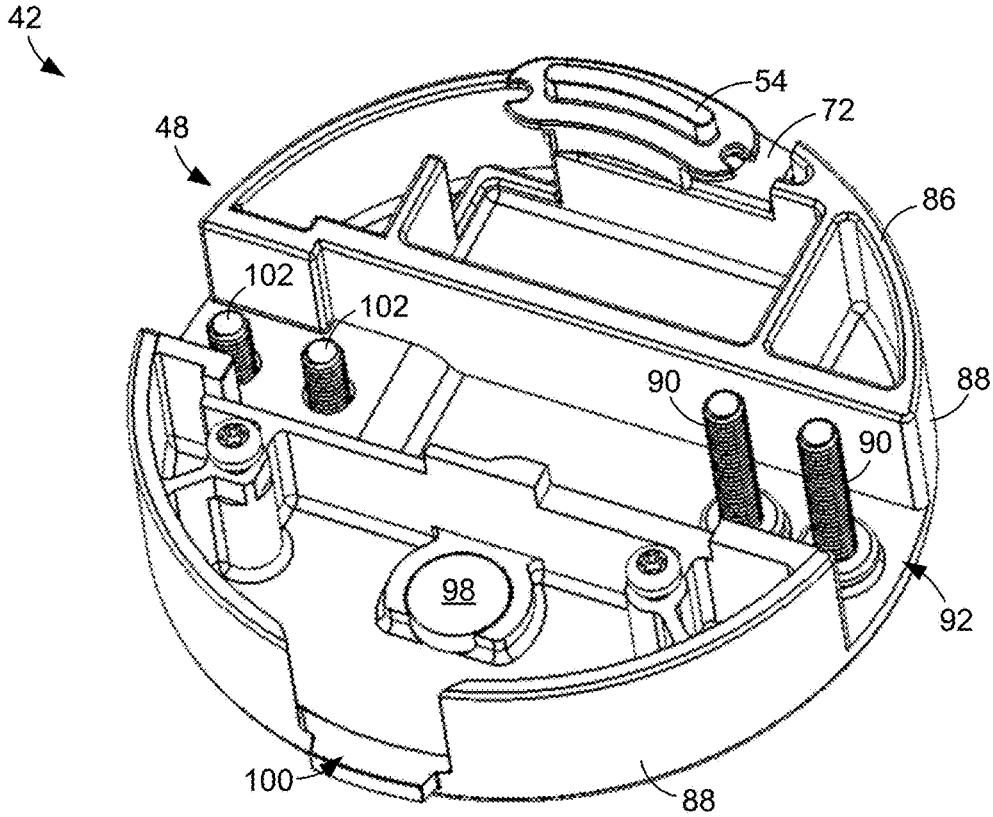
FIG. 7 is a top perspective view of the user interface device of FIG. 6, shown with a printed circuit board and a battery of the device also removed.

FIGS. 6 and 7 show the user interface device 42 with the top housing member 46 removed so as to reveal more of the bottom housing member 48 and internal components of the device that are received within an inner space defined by the bottom housing member. As illustrated in FIG. 6, these components include a printed circuit board (PCB) 76 to which is mounted the electrical connector 60. Also mounted to the PCB 76 is a microcontroller 78 configured to control the overall operation of the user interface device 42, an inertial measurement unit (IMU) 80 configured to sense movement and the orientation of the device, and a wireless transceiver 82 configured to wirelessly communicate with the wireless receiver 16. In some embodiments, the IMU 80 is a 9 degree-of-freedom IMU that comprises a triaxial accelerometer, a triaxial gyroscope, and a triaxial magnetometer.

With further reference to FIG. 6, the internal components of the user interface device 42 further comprise a load cell 84 that attaches the top housing member 46 to the bottom housing member 48. Notably, the load cell 84 provides the only physical connection between the top housing member 46 and the bottom housing member 48, unless the two members are moved toward each other to the extent that the arcuate inner ridge 68 of the top housing member abuts the top edge 86 of the arcuate lateral wall 88 of the bottom housing member. This limitation on the relative movement of the housing members 46, 48 limits the force that can be applied to the load cell 84 and, therefore, protects the load cell from damage. With such an attachment scheme, forces applied to one or both of the housing members 46, 48 can be both sensed and measured. As shown in the figure, fastening elements 90, in the form of threaded bolts, can pass through openings in the load cell 84 and be received by the fastening elements, such as threaded fasteners, provided in the boss 70 shown in FIG. 5. As can be appreciated from reference to that figure, the vertical tangs 74 can be received within a gap 92 formed in the lateral wall 88 of the bottom housing member 48 shown in FIG. 6. In some embodiments, one tang 74 is positioned on each side of the load cell 84 within the gap 92 to prevent relative rotation between the top and bottom housing members 46, 48.

Also visible in FIG. 6 is a rechargeable battery 94 that provides power to the electrical components of the user interface device 42. In addition, shown in the figure is a light source 96 that provides visual feedback to the user. In some embodiments, the light source 96 includes one or more light emitting diodes (LEDs) that emit light that is transmitted through the lens 54.

FIG. 7 shows the user interface device 42 with the PCB 76, load cell 84, and the battery 94 removed. Visible in the figure because of such removal is a vibration motor 98 configured to provide vibratory feedback to the user of the device 42. Also visible is an opening 100 formed in the arcuate lateral wall 88 through which the electrical connector 60 extends. In addition, FIG. 7 shows further fastening elements 102, in the form of further threaded bolts that are used to secure the load cell 84 to the bottom housing member 48.

Figure 8:
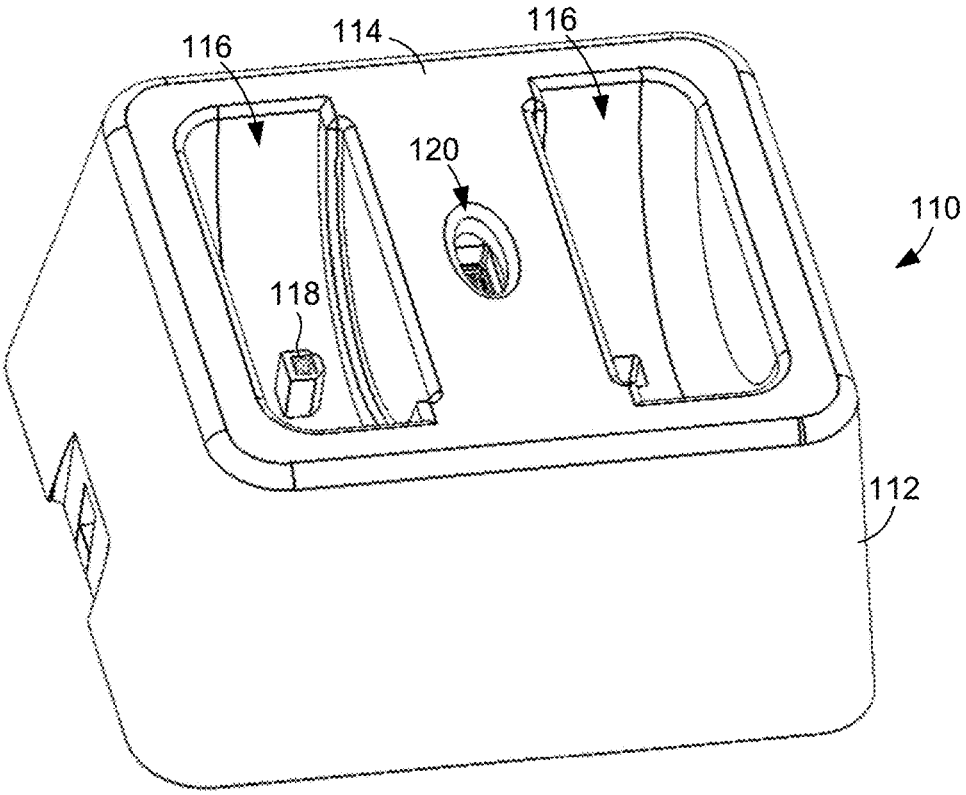
FIG. 8 is a top perspective view of a docking station of the system of FIG. 1.
Figure 9:
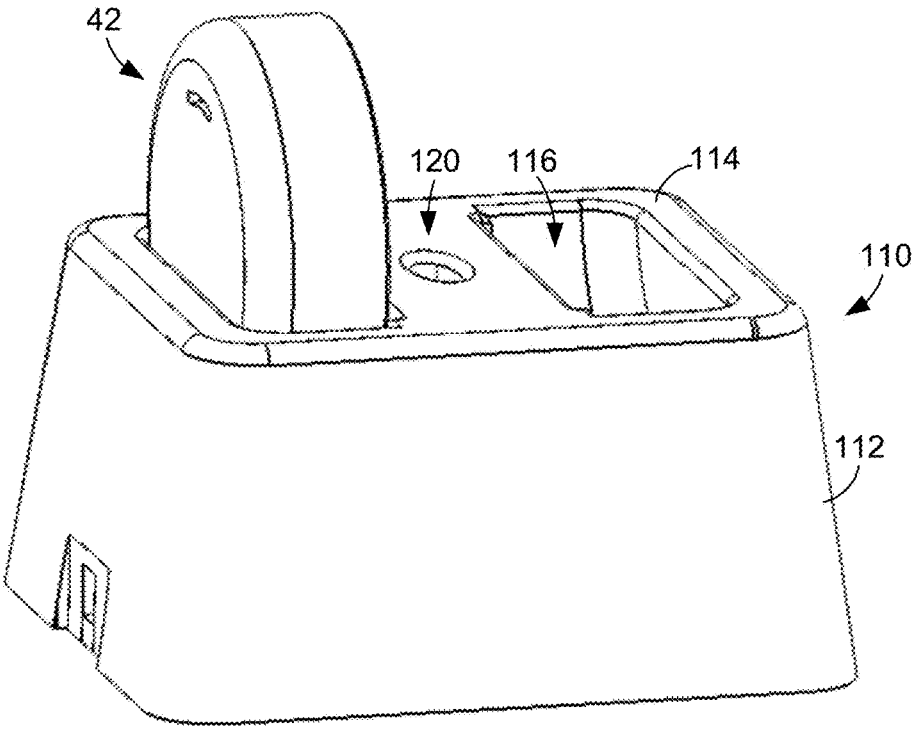
FIG. 9 is a further top perspective view of the docking station of FIG. 8, shown with a user interface device docked in the station.

FIGS. 8 and 9 illustrate an example embodiment for the docking station 18 shown in FIG. 1. In this embodiment, a docking station 110 comprises an outer housing 112 that comprises a top wall 114 that defines two semicircular cavities 116 into which the user interface devices 42 can be inserted. At the bottoms of these cavities 116 are male electrical connectors 118, such as male USB connectors (e.g., male USB-B connectors), that are adapted to mate with the female electrical connectors 60 of the user interface devices 42. Also formed in the top wall 114 of the outer housing 112 is a cavity 120 into which the wireless receiver 16 can be inserted. When the wireless receiver 16 is inserted into its cavity 120 and one or both of the user interface devices 42 are inserted into their cavity or cavities 116, the wireless receiver 16 and the user interface device(s) can be automatically synchronized so as to use the same wireless frequency. In particular, the docking station 110 selects a random frequency and communicates that frequency to the wireless receiver 16 and the user interface devices 42.

The above-described system is designed for neurorehabilitation across a broad range of movement impairments. The user interface devices can wirelessly communicate with the exercise software. When the user interface devices are fully charged in the docking station, they are ready for approximately 3 days of continual use and enable individuals with stroke or other ailments to easily plug and unplug the devices with only one hand. Using the algorithms of the exercise software and data from the IMU and load cell in each user interface device, the system can measure execution of a wide range of exercises for the hands, arms, trunk, and legs, all in real time. In some embodiments, each exercise requires manipulating one or both of the user interface devices to match images displayed to the user by the exercise software. As such, the system mixes interactions with a physical object with virtual feedback. The exercise software can comprise a library that contains a plurality of exercises and is readily adaptable to include more exercises. Examples of exercises are: reach-to-target, pincer grasp, wrist supination/pronation, weight bearing exercises, sitting crunches, leg lifts, and dorsiflexion. As the exercises are performed, the data collected and wirelessly transmitted by the user interface devices can be used to calculate the relative orientation of each device in a fixed reference frame as well as the relative rotation, translation, or force applied to each device.

Figure 10:
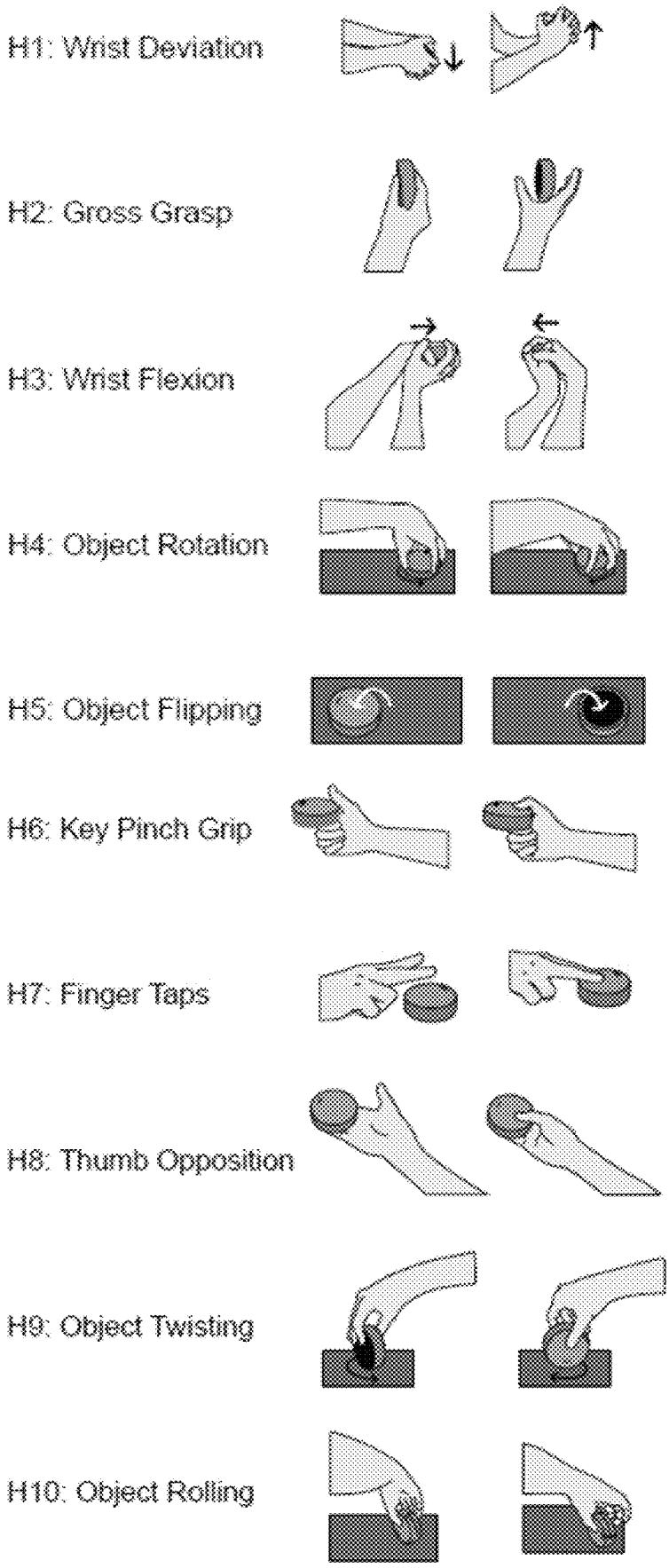
FIG. 10 illustrates a group of pictographic instructions for performing hand exercises with the user interface devices.
Figure 11:
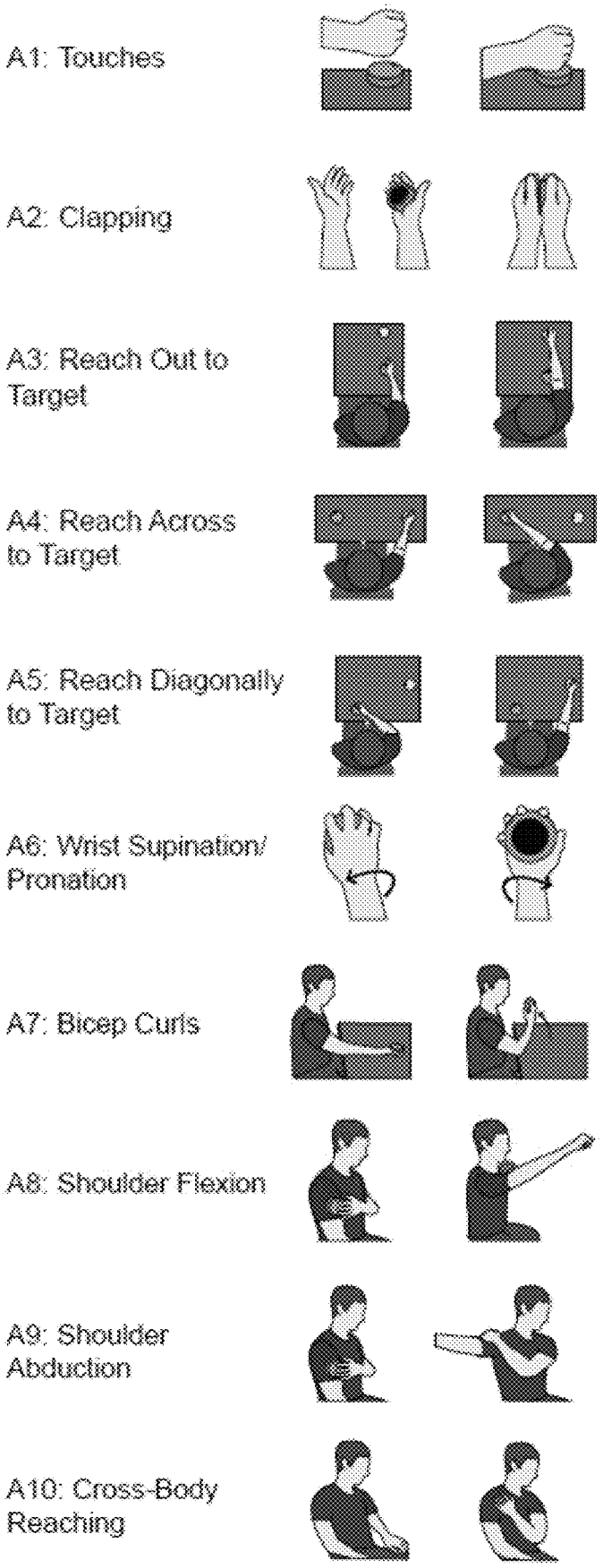
FIG. 11 illustrates a group of pictographic instructions for performing arm exercises with the user interface devices.
Figure 12:
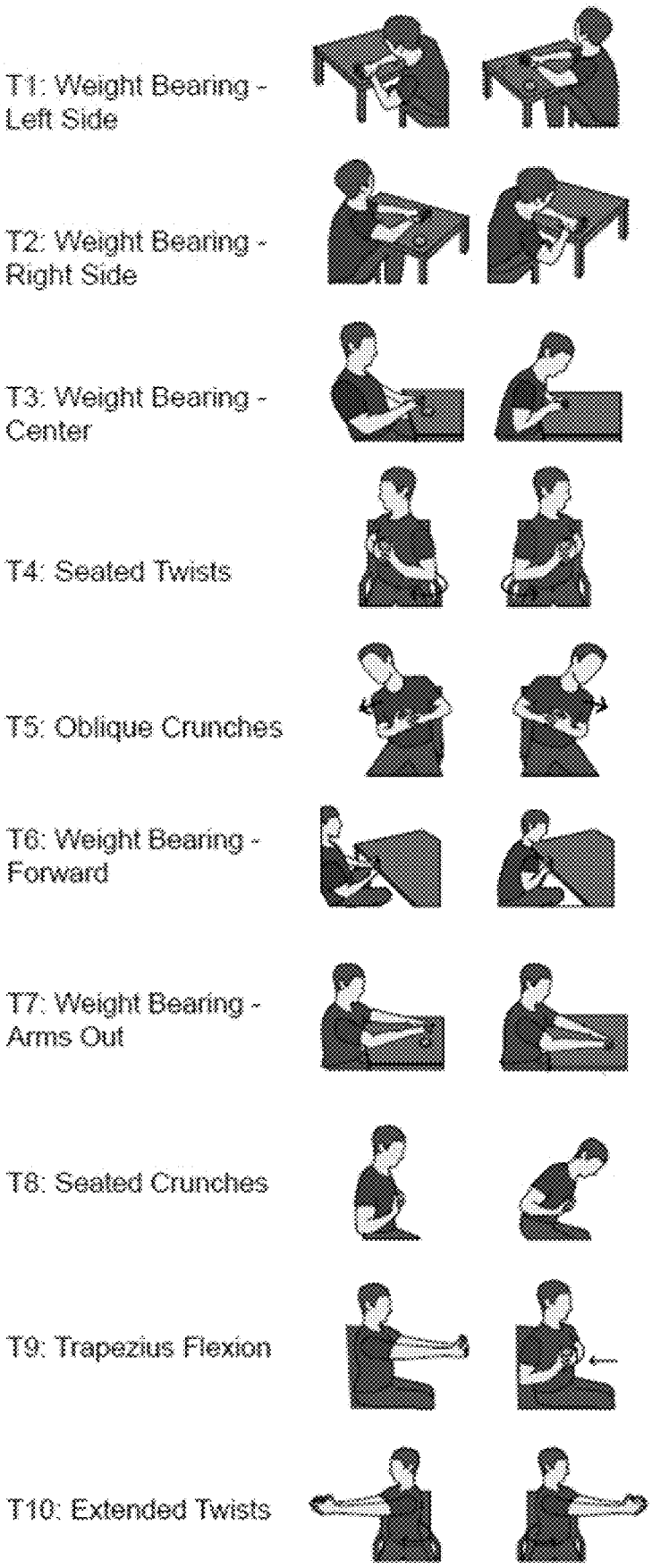
FIG. 12 illustrates a group of pictographic instructions for performing trunk exercises with the user interface devices.
Figure 13:
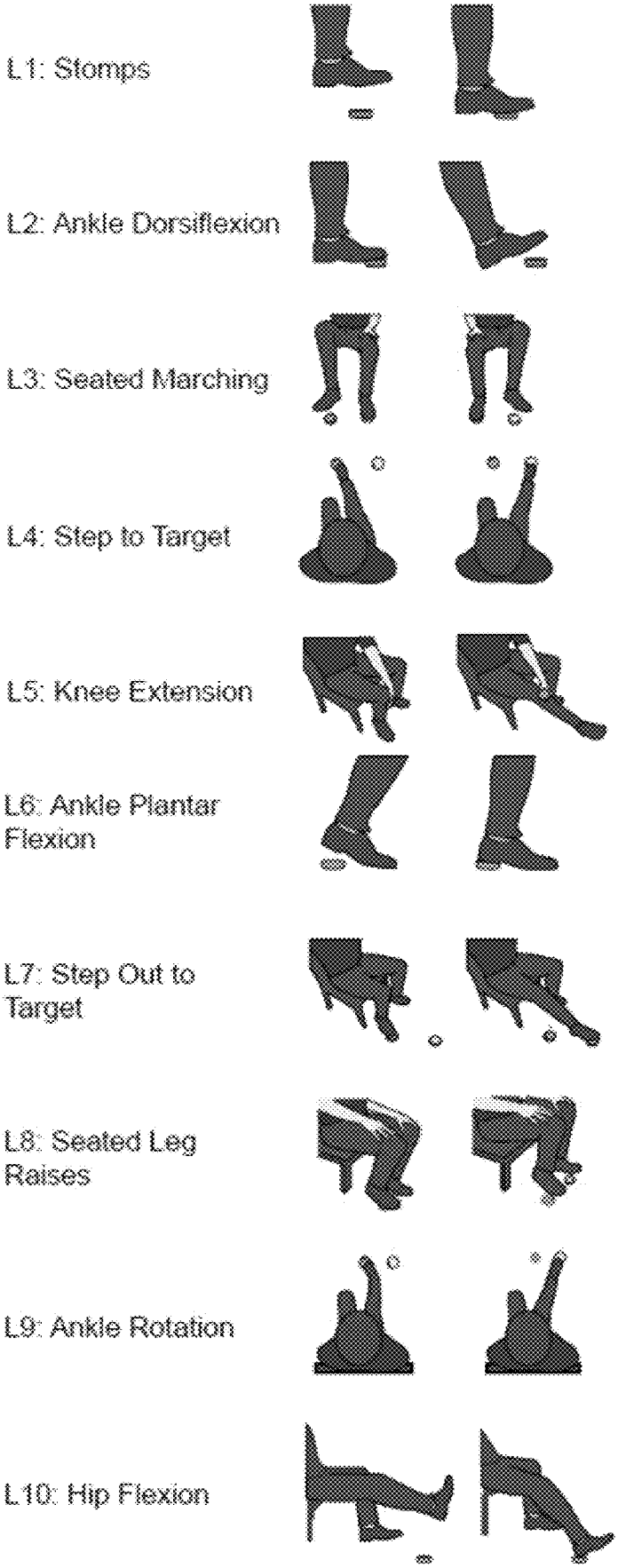
FIG. 13 illustrates a group of pictographic instructions for performing leg exercises with the user interface devices.

In some embodiments, the exercise system uses exercises that each have a distinct "beginning" state and "ending" state, and then uses the data from the user interface devices' sensors to detect when the user moves between each of these two states, thus completing a repetition. FIGS. 10-13 pictographically illustrate examples of such exercises. More particularly, FIG. 10 illustrates hand exercises H1-H5, FIG. 11 illustrates arm exercises A1-A10, FIG. 12 illustrates includes trunk exercises T1-T10, and FIG. 13 illustrates leg exercises L1-L10. As can be appreciated from these examples, many different exercises can be performed using various parts of one's body. Also, as mentioned above, each exercise has a distinct beginning state and ending state. For example, as shown in FIG. 11 under the heading "A3: Reach Out to Target," the system can direct the user to perform a reach-to-target arm exercise by pictographically instructing them to touch a first user interface device near their body (the beginning state), and then touch a second puck several inches away (the ending state). The system can then monitor when a repetition of this exercise is completed by detecting touch events from each device's load cell data. One major benefit of this approach is that the system can accurately and consistently detect the completion of a wide variety of exercises with minimal and easy-to-use hardware, including fine motor tasks that mimic daily functions, such as rolling objects back and forth on a table, stacking objects, or flipping objects. This enables a single system to be used for performing and monitoring exercises for the hand, arm, trunk, and leg that are appropriate for an individual's specific impairments.

In some embodiments, the exercise software can be configured as a "mixed-reality gym" that enables users to practice a selected set of exercises, receive a target number of repetitions for each exercise, and then receive real-time feedback on their performance. The software can also track a user's performance history for each exercise over time and can store this data locally and/or on web-server so that a therapist can monitor compliance. Users can be shown written instructions and large, easy-to-understand images that illustrate the beginning state and ending state for each exercise, the number of repetitions completed out of a target goal, and a feedback bar that shows the current exercise state a user is in and highlights the state the user needs to move towards. The software can also play an audible beat and the user interface devices can vibrate each time the user moves into the correct exercise state.

In other embodiments, the exercise software is configured as a game where users interact with the game by making specific movements with the user interface devices. In one embodiment, users must make a specific movement according along to different cues that are presented to the user. For example, if the user sees a blue circle, he/she must perform one repetition of a reach-to-grasp movement. In another embodiment, users manipulate a character on the screen in a side scroller-type game. For example, when the user holds the puck and rotates his hand to a palm up position, the virtual character moves right in the game, when the user holds the puck and rotates his hand to a palm down position the virtual character moves left in the game, and when the user squeezes the puck the virtual character jumps up in the game.

Notably, a unique challenge in any unsupervised home therapy system is that a user may perform an exercise incorrectly, since a therapist is not there to correct them. For this reason, the exercise software can, in some embodiments, play 10-30 second instructional videos before each exercise in which a physical or occupational therapist explains how to perform the exercise correctly and how to prevent any negative compensation patterns.

The invention claimed is:

1. An exercise system comprising:

a user interface device sized and configured to fit within a user's hand, the user interface device including an outer housing having a first housing member and a second housing member that together define an inner space in which are provided a microcontroller configured to control operation of the user interface device, a first sensor configured to sense movements of the user interface device, a second sensor configured to sense forces applied to the user interface device, and a communication device configured to communicate data concerning the sensed movements and forces to a wireless receiver, wherein the first and second housing members are connected to each other only by the second sensor such that a force with which the first housing member is pressed against the second housing member, and vice versa, can be measured;

a computing device in communication with the user interface device, via the wireless receiver the computing device comprising software configured to guide the user through predetermined exercises, to receive the data communicated by the user interface device concerning the sensed movements and forces, and analyze the data to evaluate the user's performance of the exercises; and a docking station configured to receive and recharge the user interface device, wherein the user interface device is configured as a short cylindrical puck having approximately the same size and shape of a conventional hockey puck and wherein the docking station comprises a semicircular cavity configured to receive the user interface device.

2. The system of claim 1, wherein the communication device comprises a wireless transceiver configured to wirelessly transmit the data concerning the sensed movements and forces to the computing device.

3. The system of claim 2, wherein the wireless receiver is configured to plug into the computing device.

4. The system of claim 3, wherein the user interface device comprises an internal rechargeable battery.

5. The system of claim 1, wherein the first sensor comprises an inertial measurement unit that is further configured to determine an orientation of the user interface device.

6. The system of claim 5, wherein the inertial measurement unit comprises a triaxial accelerometer, a triaxial gyroscope, and a triaxial magnetometer.

7. The system of claim 1, wherein the second sensor comprises a load cell.

8. The system of claim 1, wherein the docking station is further configured to receive the wireless receiver and automatically synchronize the wireless receiver for wireless communication with the communication device of the user interface device when both the wireless receiver and user interface device are received in the docking station.

9. The system of claim 1, wherein the user interface device further includes a vibration motor configured to provide vibratory feedback to the user.

10. The system of claim 1, wherein the first and second housing members are each made of a hard plastic material that is covered with an elastomeric coating.

11. The system of claim 1, wherein the user interface device further comprises an electrical connector configured to receive a mating connector with which the user interface device can be connected to the docking station.

12. The system of claim 2, wherein the first housing member includes a circular, rounded edge.

13. The system of claim 1, wherein the second housing member is smaller than the first housing member and is received within the first housing member.

14. The system of claim 1, wherein the outer housing further has an internal mechanical stop that limits movement of the first housing member toward the second housing member and vice versa.

15. The system of claim 1, wherein the outer housing further has an internal mechanical stop that limits relative rotational movement of the first and second housing members.

16. The system of claim 1, wherein an electrical connector is provided within the semicircular cavity, the electrical connector being configured to connect to the user interface device to recharge it.

17. The system of claim 1, wherein the system comprises two user interface devices, each having the same configuration.

* * * * *